United States Patent [19]

Civolani

[11] 4,322,906

[45] Apr. 6, 1982

[54] TRIGGER MECHANISM FOR AUTOMATIC AND SEMIAUTOMATIC FIREARMS OF ANY TYPE

[75] Inventor: Bruno Civolani, Bologna, Italy

[73] Assignee: Benelli Armi S.p.A, Urbino, Italy

[21] Appl. No.: 63,180

[22] Filed: Aug. 3, 1979

[30] Foreign Application Priority Data

Oct. 27, 1978 [IT] Italy ..... 44022 A/78

[51] Int. Cl.[3] ..... F41C 17/02

[52] U.S. Cl. ..... 42/70 E

[58] Field of Search ..... 42/69 B, 70 E; 89/139, 89/140, 142, 144, 148

[56] References Cited

U.S. PATENT DOCUMENTS

| | | | |
|---|---|---|---|
| 992,854 | 5/1911 | Cobb | 42/69 B |
| 2,448,810 | 9/1948 | Koucky et al. | 42/69 B |
| 2,539,644 | 1/1951 | Turner | 42/69 B |

*Primary Examiner*—Stephen C. Bentley

[57] ABSTRACT

A trigger mechanism for semi-automatic and automatic firearms is provided which comprises a hammer having a release dog and a trigger having a stop dog for the cocking and safety positions assumed by the trigger during the various steps of operation of the trigger mechanism.

4 Claims, 3 Drawing Figures

TRIGGER MECHANISM FOR AUTOMATIC AND SEMIAUTOMATIC FIREARMS OF ANY TYPE

The present invention relates to important improvements in trigger mechanisms for automatic and semiautomatic firearms and more particularly to a trigger mechanism which performs all the functions thereof by combining the reciprocal movements of hammer and trigger, i.e. the sole elements forming the mechanism, thereby attaining remarkable technical and economical advantages.

It is known that the trigger mechanisms are generally comprised of four or more elements including two or more hammer interlocks for the cocking and safety positions needed for a correct operation of the trigger mechanisms.

Trigger mechanisms are also known, which are comprised of two elements only, but they normally consist of two hammer interlocks for the cocking and safety positions.

The trigger mechanisms of the former type already known require a strict machining accuracy for the movements of the individual components to be smooth and well coordinated to each other in order that an excessive friction does not result during the contact of the hammer interlock in said cocking and safety positions.

There is also the disadvantage that the wear of even an interlock only causes an unbalance of the movements of the individual pieces resulting eventually in the failure of the trigger mechanism due to a faulty operation.

Finally, it is very difficult if not impossible to completely eliminate the clearance on the trigger as the hammer is in the cocking position.

The trigger mechanisms of the latter type provided with two interlocks, while presenting some advantages over the former ones, have always a remarkable complexity in the coordination of the movements of the individual components and generally the trigger actuating finger "feels" the transition of the hammer from the safety interlock to the cocking interlock positions.

This invention aims to overcome all the above mentioned disadvantages by providing a trigger mechanism comprising two elements only and ensuring through the coordination of simple movements, the cocking and safety positions of the hammer by means of a single interlock.

More particularly the trigger mechanism according to the present invention is characterized in that the hammer is provided with a stop dog and the trigger is provided with a release-dog in such a position as to create during the operation a single interlock for the cocking position and the safety position which the hammer can assume.

Accordingly, by normally acting on the trigger pivoting on its pin, the hammer is released from its cocking position.

When released, the trigger, due to the action of the finger pressure which causes the actuation thereof, accomplishes a limited backward movement before coming in a stop position.

This movement is not felt by the trigger actuating finger in that it occurs as soon as the hammer release has taken place and therefore the reaction of the hammer release on the trigger nullifies the backward movement accomplished thereby on the actuating finger.

As the hammer is recocked by the action of the arm on which the trigger mechanism of the invention is mounted, the hammer dog engages again the dog of the trigger which is still at the end of stroke due to the finger pressure exerted by the shooter.

In order to fire another shot it is therefore necessary for the shooter to return the trigger to a rest position.

However, the trigger in so doing, moves again in a forward position by the action of a return spring, thereby preventing the release of the hammer which remains thus in a cocked position.

Only when the trigger is again actuated the release of the hammer from its cocked position occurs.

The above description relates to an application of the trigger mechanism to a semiautomatic arm.

When it is desired to apply the trigger mechanism to an automatic arm it is sufficient that the burst firing selector engages through a protuberance thereof the trigger in such a manner that, during the use, the limited backward movement of the trigger is prevented.

In this manner the trigger mechanism is suitable for the automatic firing or for a single-shot firing according to the position of the burst firing selector.

The invention will be better understood from the following detailed description of an embodiment thereof given by way of example only and applied to a semiautomatic arm in which the known elements, such as the hammer cocking device and the percussion device are omitted, and illustrated in the accompanying drawings, wherein.

Figure 1:
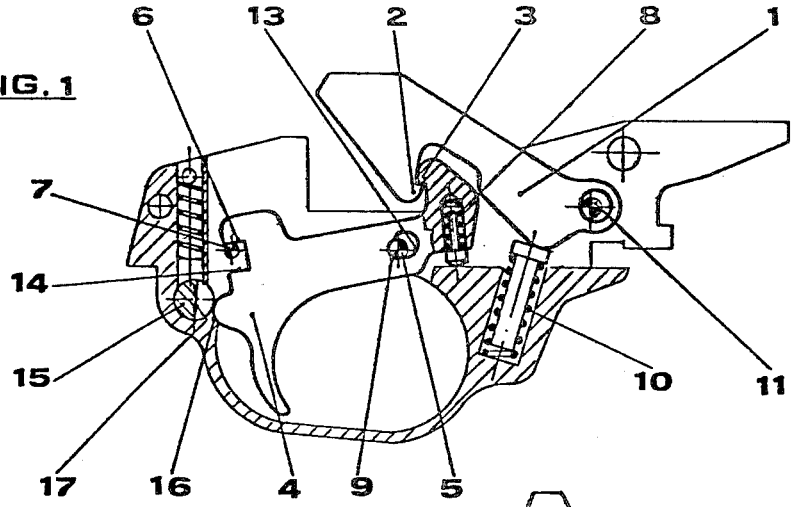
FIG. 1 is a fragmentary axial section view of a trigger guard assembly with the trigger mechanism in a cocked position wherein the hammer is engaged by means of its release dog on the trigger dog which is free at the end of its forward stroke.

Assuming that the arm is ready-to-fire, the trigger mechanism (FIG. 1) has the hammer 1 in a cocked position with the hammer dog 2 in engagement with the associated dog 3 of trigger 4.

The trigger 4, pivotally mounted on a fastening pin 5, has a rear notch and is free at the end of its forward stroke defined by the abutment of the notch edge 6 against pin 7 being kept in this position by the return spring 8.

In order to fire the arm the shooter pulls the trigger 4 which by rotating by means of the eyelet 9 about the fastening pin 5, disengages its dog 3 from the release dog 2 of the hammer 1.

At the time of firing (FIG. 2), as the hammer (1) biased by the spring 10 pivots in a forward direction about its pin 11 in order to strike the firing pin 12, the trigger 4 always pulled by the shooter's finger, accomplishes a limited backward movement until the edge 13 of the eyelet 9 is brought in contact with the fastening pin 5 and then stops in the position at the end of its stroke defined by the contact of the notch edge 14 with pin 7.

Figure 2:
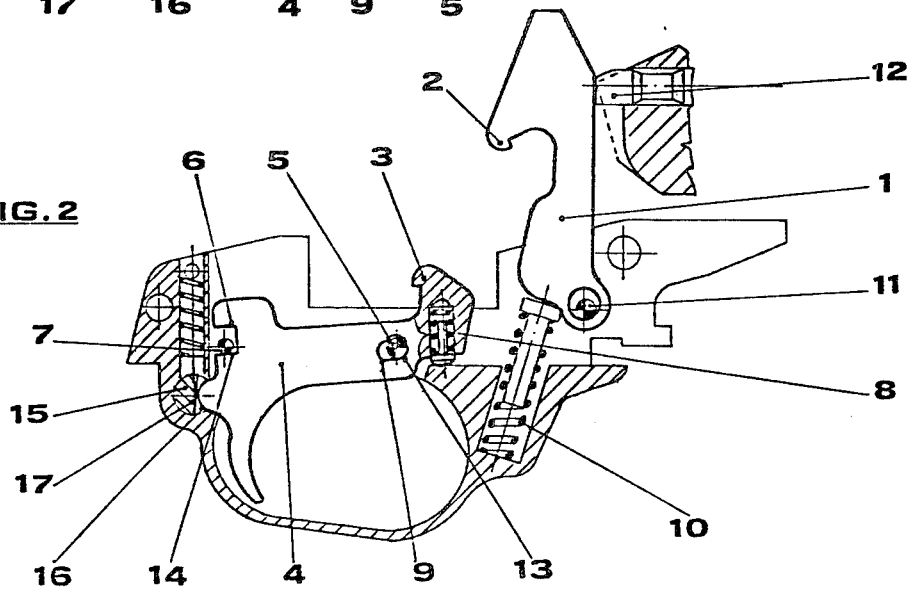
FIG. 2 is a fragmentary axial section view of a trigger guard assembly with the trigger mechanism in a percussion position wherein the hammer strikes the firing pin whereas the trigger is at the end of its backward stroke under the pressure of the actuating finger.
Figure 3:
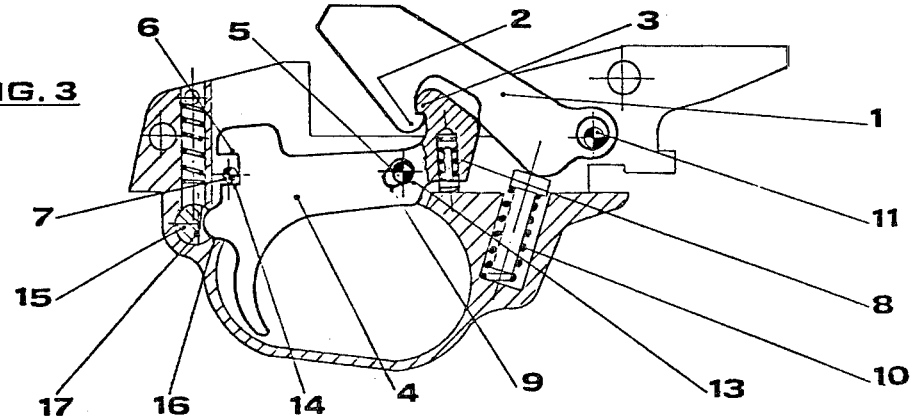
FIG. 3 is a fragmentary axial section view of a trigger guard assembly with the trigger mechanism in a safety stop position wherein the hammer is engaged by means of its release dog on the dog of trigger which is at the end of its backward stroke under the pressure of the actuating finger.

The hammer 1 is soon recocked by the arm action after the cartridge has been fired since the trigger is again pulled by the shooter's finger in the backward end position already shown in FIG. 2 and the release dog 2 of the hammer is engaged by the dog 3 of the trigger 4, thereby preventing the firing of a second shot.

Thereafter, when the shooter finger releases the trigger 4, the latter under the force of the return spring 8 moves again to a cocked position (FIG. 1); the trigger 4 is in a forward end position defined by the abutment of the notch edge 6 against the pin 7, with the eyelet 9 contacting the fastening pin 5 and the hammer 1, during this movement, remains in a cocking position with the release dog 2 engaged by the dog 3 of trigger 4.

It should be understood that in order to fire another cartridge it is necessary to repeat the above sequence of movements, thereby obtaining the purpose of having a trigger mechanism for semi-automatic firearms formed of two elements only with a single hammer interlock for the cocking and safety stop positions that the hammer can assume.

In the embodiment just described the safety of the trigger mechanism is provided by the safety pin 15 which may have two defined positions on the arm.

In a safety position the safety pin 15 contacts the protuberance 16 (FIG. 1) of the trigger 4 by preventing any movement thereof.

In a firing position the safety pin 15 permits the trigger 4 to accomplish the above-mentioned movements in that the protuberance 16 enters the safety pin 15 due to the slot defined by the surface 17 provided thereon.

For an application of the trigger mechanism to an automatic firearm it may be sufficient to substitute a three position safety pin for the two position safety pin 15. In addition to the two above-mentioned positions another position must be provided for the burst firing.

For this position the slot provided on the safety pin will be of such extent as to permit the pivotal movement of the trigger for the release of hammer but not so extended as to permit the limited backward movement.

It should be understood that the above embodiments are given merely by way of example and not intended in a limited sense and that various changes and modifications can be made thereto without departing from the scope of the invention.

More particularly this invention is intended to cover all the trigger mechanisms which, in order to be suited to the firearm on which they are mounted, require different constructions or different arrangements of the safety pin or burst firing selectors as well as different arrangement of the return springs of trigger or hammer.

Also covered by the invention are intended other uses of trigger mechanisms according to the invention than those shown and described, no particular importance being given to the materials and to the working thereof.

What I claim is:

1. A trigger mechanism for a firearm comprising an elongated hammer pivotally mounted at one end thereof on said firearm to be rotated in one direction from a cocked position to a firing position and subsequently to be rotated in the reverse direction to a safety position, said hammer at an intermediate portion having a first projecting dog formed thereon;

a trigger means having a forward portion and a rearward portion, said forward portion having a pivotal mounting on said firearm, and said forward portion including a second projecting dog formed thereon for selective engagement with said first dog in said cocked position and said safety position;

said rearward section of said trigger means including a notch having upper and lower edges engageable with a stop pin mounted on said firearm to provide limited rotation of said trigger means, said upper edge being in contact with said stop pin when said hammer and trigger means are in said cocked position, and said lower edge being in contact with said stop pin when said hammer and trigger means are in said firing position and said safety position.

2. A trigger mechanism according to claim 1 wherein said hammer is biased to rotate into said firing position when said first and second dogs are disengaged, and said trigger means is biased to maintain its said upper edge in contact with said stop pin in said cocked position.

3. A trigger mechanism according to claim 1 wherein said pivotal mounting of said trigger means comprises a pivot pin mounted on said firearm and a lost motion connection provided by an elongated opening in said trigger means to receive said pivot pin.

4. A trigger mechanism according to claim 1 wherein a protuberance is formed on said rearward section of said trigger means, and a notched section is formed in said firearm to receive said protuberance when said trigger means is moved backward.

* * * * *